US010931048B2

(12) United States Patent
Amini et al.

(10) Patent No.: US 10,931,048 B2
(45) Date of Patent: Feb. 23, 2021

(54) DECOUPLED SPRING AND ELECTRICAL PATH IN CONNECTOR INTERFACE

(71) Applicant: Apple Inc., Cupertino, CA (US)

(72) Inventors: Mahmoud R. Amini, Sunnyvale, CA (US); Nikhil S. Pansare, Cupertino, CA (US); William P. Cornelius, Saratoga, CA (US); Seungyong Baek, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/581,101

(22) Filed: Sep. 24, 2019

(65) Prior Publication Data

US 2020/0099156 A1 Mar. 26, 2020

Related U.S. Application Data

(60) Provisional application No. 62/735,391, filed on Sep. 24, 2018.

(51) Int. Cl.

| | |
|---|---|
| ***H01R 13/11*** | (2006.01) |
| ***H01R 12/59*** | (2011.01) |
| ***H01R 13/6581*** | (2011.01) |
| ***H01R 13/62*** | (2006.01) |

(52) U.S. Cl.

CPC ..... *H01R 13/113* (2013.01); *H01R 12/592* (2013.01); *H01R 13/6205* (2013.01); *H01R 13/6581* (2013.01)

(58) Field of Classification Search

CPC ..... H01R 13/113; H01R 13/6205; H01R 13/6581; H01R 12/59; H01R 12/592

See application file for complete search history.

(56) References Cited

U.S. PATENT DOCUMENTS

| | | | | |
|---|---|---|---|---|
| 4,477,134 | A * | 10/1984 | Wright | H01L 23/32 200/51.1 |
| 5,975,934 | A * | 11/1999 | Ichimura | H01R 12/89 439/260 |
| 7,544,066 | B1 | 6/2009 | Lynch | |
| 2006/0234542 | A1* | 10/2006 | Ko | H01R 12/592 439/495 |
| 2008/0214043 | A1* | 9/2008 | Ko | H01R 12/592 439/494 |
| 2015/0162684 | A1* | 6/2015 | Amini | H01R 24/60 439/660 |
| 2017/0229801 | A1* | 8/2017 | Underwood | H01R 13/2407 |
| 2017/0271806 | A1* | 9/2017 | Kato | H01R 13/629 |
| 2017/0310048 | A1* | 10/2017 | Kato | H01R 13/518 |
| 2019/0103700 | A1* | 4/2019 | Esmaeili | H01R 12/592 |
| 2019/0190214 | A1* | 6/2019 | Choi | H01R 13/04 |

* cited by examiner

*Primary Examiner* — Oscar C Jimenez
(74) *Attorney, Agent, or Firm* — Kilpatrick Townsend & Stockton LLP

(57) ABSTRACT

Connectors that support high-speed data transfers and have a high signal quality, good reliability, and are readily manufactured. One example can provide a connector receptacle that supports high-speed data transfers and has a high signal quality by employing connector contacts that include multiple structures.

20 Claims, 14 Drawing Sheets

DECOUPLED SPRING AND ELECTRICAL PATH IN CONNECTOR INTERFACE

CROSS REFERENCE TO RELATED APPLICATIONS

This application claims the benefit of U.S. provisional application No. 62/735,391, filed Sep. 24, 2018, which is incorporated by reference.

BACKGROUND

Power and data can be provided from one electronic device to another over cables that can include one or more wires, fiber optic cables, or other conductors. Connector inserts can be located at each end of these cables and can be inserted into connector receptacles in the communicating electronic devices.

Large amounts of data can be transferred among these connected electronic devices. But data transfers can be costly in terms of time and computing power. In order to reduce these data transfer times, it can be desirable that these connectors be capable of supporting high data rates. That is, it can be desirable that these connectors provide a high signal quality or signal integrity to allow high speed data transfers among connected electronic devices.

These connector inserts can be inserted into connector receptacles many times over the lifetime of an electronic device. Some devices can be connected to chargers, home or car audio equipment, or other types of electronic devices several times a day. Accordingly, it can be desirable that these connector inserts and connector receptacles be reliable and be able to withstand a high number of insertions and extractions.

Also, some of these electronic devices become tremendously popular. As a result, connector receptacles on the electronic devices and connector inserts on cables can be sold in very large quantities. Therefore, it can be desirable that these connectors be readily manufactured such that customer demand for them can be met.

Thus, what is needed are connectors that support high-speed data transfers and have a high signal quality, good reliability, and are readily manufactured.

SUMMARY

Accordingly, embodiments of the present invention can provide connectors that support high-speed data transfers and have a high signal quality, good reliability, and are readily manufactured.

An illustrative embodiment of the present invention can provide a connector receptacle that supports high-speed data transfers and has a high signal quality by employing connector contacts that include multiple structures. These multiple-structure contacts can use different structures for the various functions that can be performed by connector contacts. For example, spring contact forces can be provided by spring fingers, where the spring fingers do not actually convey signals or power but are utilized to provide a good mechanical and electrical connection between contacts in mated connectors. Since signals are not routed through the spring fingers, they can be formed of materials that are selected to provide a good spring force without regards to their conductivity. Since the remaining structures do not need to provide a spring force, contacts on a flexible printed circuit board (or flexible circuit board) can serve as electrical contacts to convey signals for the connector. In this way, signals at contacts of the connector can be routed through traces in the flexible circuit board. Traces on the flexible circuit board can be shielded, they can be part of a strip-line, or they can be (or can be part of) another routing structure used to improve signal quality and signal integrity. These routing techniques can reduce cross-talk, reduce electromagnetic interference, and enable a high data rate. Also, since the traces in the flexible circuit board can begin at contacting portions of the flexible circuit boards, stubs which can be located at an end of a traditional beam contact, can be reduced or eliminated for further improved high-frequency performance.

Differential signals conveyed by traces in these flexible circuit boards can be well-shielded. For example, a high-speed differential signal can be conveyed on two contacts formed on, or attached to, traces on an outside surface of the flexible circuit board. The two traces can connect to two vias of the flexible circuit board. The differential signal can then be conveyed by the vias to two traces on a middle layer of the board. Each pair of traces can be laterally shielded by ground or power supplies, as well as a ground plane on the bottom layer and a ground plane on the top layer. Positioning the vias such that there is short distance between the contacts and the vias can also help to shield the differential signals by allowing the ground planes to be positioned close to the contacts.

In these and other embodiments of the present invention, spring fingers can be located against a housing or shield of a connector insert. A flexible circuit board can have a portion that can be located on a surface of the spring fingers away from the housing or shield. The flexible circuit board can be glued or otherwise fixed to the spring fingers using pressure-sensitive adhesive, heat activated adhesive, temperature-sensitive adhesive, or other adhesive, laser or spot welding, or other appropriate material or process. Contacts can be formed on surfaces of contacting portions of the flexible circuit board away from the spring fingers. The contacts formed on the surface the contacting portions of the flexible circuit board can directly and electrically connect to contacts of a corresponding connector. The contacts can be plated, formed by vapor deposition, soldered, or formed in other ways on the contacting portions of the flexible circuit board In these and other embodiments of the present invention, each spring finger can provide support for one contacting portion of a flexible circuit board. This arrangement can work well to ensure that each contact on a contacting portion of a flexible circuit board has a force to push it against a corresponding contact when the contact on the contacting portion of the flexible circuit board is mated with the corresponding contact of a corresponding connector.

In these and other embodiments of the present invention, each spring finger can provide support for two contacting portions of a flexible circuit board. Having two contacting portions supported by each spring finger can help to ensure that each contact on a contacting portion of a flexible circuit board has a force to push it against a corresponding contact when the contact on the contacting portion of the flexible circuit board is mated with the corresponding contact of a corresponding connector.

In these and other embodiments of the present invention, each spring finger can provide support for more than two contacting portions of a flexible circuit board. For example, each spring finger can provide support for each of the contacting portions of a flexible circuit board. Having a limited number of spring fingers can help to simplify the assembly and manufacturing of components for a connector.

In these and other embodiments of the present invention, the spring fingers and contacting portions can be arranged in various ways. Again, each spring finger can support one, two, three, or more contacting portions. Each contacting portion can support one or more contacts. For example, a spring finger may support a contacting portion having one contact. A spring finger may support a contacting portion having two contacts. A single spring finger can support a single contacting portion having all the contacts of a row. Other configurations are also possible.

In these and other embodiments of the present invention, the spring fingers can be conductive. These spring fingers can be formed of steel, stainless steel, spring steel, copper, bronze, ceramic, or other material. The spring fingers can be held in place by being partially encased in, or attached to, a housing for the connector. The housing can be formed of plastic, a ferritic or other magnetic material (to form a magnetic element), or other conductive or nonconductive material. The spring fingers can be held in place by being attached to, or formed as part of, a shield around the connector. The spring fingers can also be held in place by a housing that is shielded by the shield. The spring fingers can be formed by stamping, metal-injection molding, forging, deep drawing, or other process.

In these and other embodiments of the present invention, the spring fingers can be nonconductive. These spring fingers can be formed of plastic, LDS plastic, ceramic, or other material. The spring fingers can be held in place by being partially encased in, or formed with, a housing for the connector. The housing can be formed of plastic, a ferritic or other magnetic material (to form a magnetic element), or other conductive or nonconductive material. The spring fingers can be formed by molding, injection molding, or other process. The spring fingers can be formed as part of the housing for the connector.

In these and other embodiments of the present invention, traces in the flexible circuit boards can electrically connect to conductors in a cable, traces in other flexible circuit boards, one or more printed circuit boards, or other appropriate routing paths. This can save space in a connector as compared to conventional beam contacts. This saved space can be used for various purposes. For example, one or more electrical components can be placed on the flexible circuit boards. One or more magnets can be placed in the connectors to provide an increase in retention force of a connector insert in a connector receptacle.

In these and other embodiments of the present invention, one or more magnets can be located in a connector insert. The magnets can magnetically attract a magnetic element on a tongue of a corresponding connector receptacle when the connector insert is mated with the corresponding connector receptacle. The magnetic element on the tongue can be formed of a ferritic or other magnetic material. For example, a tongue can include a metal-injection molded frame, where the injected metal forms a magnetic element. Magnets in the connector receptacle can attract a magnetic element near a front of the connector insert when the connector insert is mated with the corresponding connector receptacle, where the magnetic element is formed of ferritic or other magnetic material. In these and other embodiments, the magnets can be positioned, either spatially or by orientation, such that they allow the connector insert to be inserted into the connector receptacle in either of two rotational orientations separated by 180 degrees.

These multi-structure contacts can be used in various ways in connectors consistent with embodiments of the present invention. For example, these multi-structure contacts can be used as contacts in a connector insert where the multi-structure contacts directly and electrically connect to contacts on a tongue in a corresponding connector receptacle when the connector insert and the corresponding connector receptacle are mated. These multi-structure contacts can be used as contacts in a connector receptacle where the multi-structure contacts directly and electrically connect to contacts on a tongue of a corresponding connector insert when the corresponding connector insert and the connector receptacle are mated. These multi-structure contacts can also be used as contacts on a tongue of a connector insert where the multi-structure contacts directly and electrically connect to contacts in a corresponding connector receptacle when the connector insert and the corresponding connector receptacle are mated. These multi-structure contacts can be used as contacts on a tongue of a connector receptacle where the multi-structure contacts directly and electrically connect to contacts of a corresponding connector insert when the corresponding connector insert and the connector receptacle are mated.

While embodiments of the present invention can be useful as USB Type-C connector inserts and connector receptacles, these and other embodiments of the present invention can be used as connector receptacles in other types of connector systems, such as a Peripheral Component Interconnect express (PCIe) connector system.

In various embodiments of the present invention, spring fingers, contacts, shields, and other conductive portions of a connector receptacle or connector insert can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as spring fingers, housings and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards or other boards used can be formed of FR-4 or other material.

Embodiments of the present invention can provide connector receptacles and connector inserts that can be located in, and can connect to, various types of devices such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
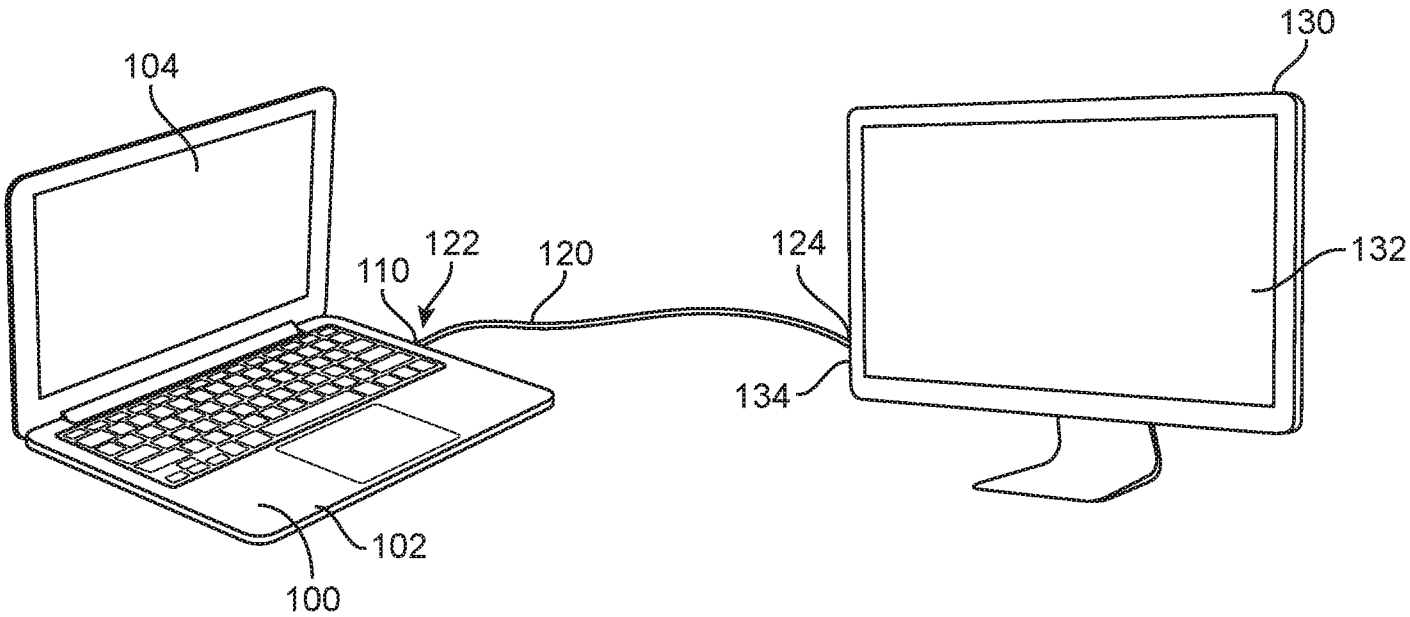
FIG. 1 illustrates an electronic system that can be improved by the incorporation of embodiments of the present invention.

FIG. 1 illustrates an electronic system that can be improved by the incorporation of an embodiment of the present invention. This figure, as with the other included figures, is shown for illustrative purposes and does not limit either the possible embodiments of the present invention or the claims.

In this example, monitor 130 can be in communication with computer 100. Computer 100 can be substantially housed in device enclosure 102. Computer 100 can provide video or other data over cable 120 to monitor 130. Video data can be displayed on the video screen 132 of monitor 130. Computer 100 can similarly include a screen 104. In these and other embodiments the present invention, other types of devices can be included, and other types of data can be shared or transferred among the devices. For example, computer 100 and monitor 130 can be portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices.

Cable 120 can be one of a number of various types of cables. For example, it can be a Universal Serial Bus (USB) cable such as a USB Type-C cable, Thunderbolt, DisplayPort, Lightning, or other type of cable. Cable 120 can include compatible connector insert 110 and compatible connector insert 124 that plug into connector receptacle 122 on computer 100 and connector receptacle 134 on monitor 130. Examples of connector inserts 110 and connector receptacles (which can be the same or different as connector inserts 124, connector inserts 900, and connector receptacle 134) are shown in the following figures.

Figure 2:
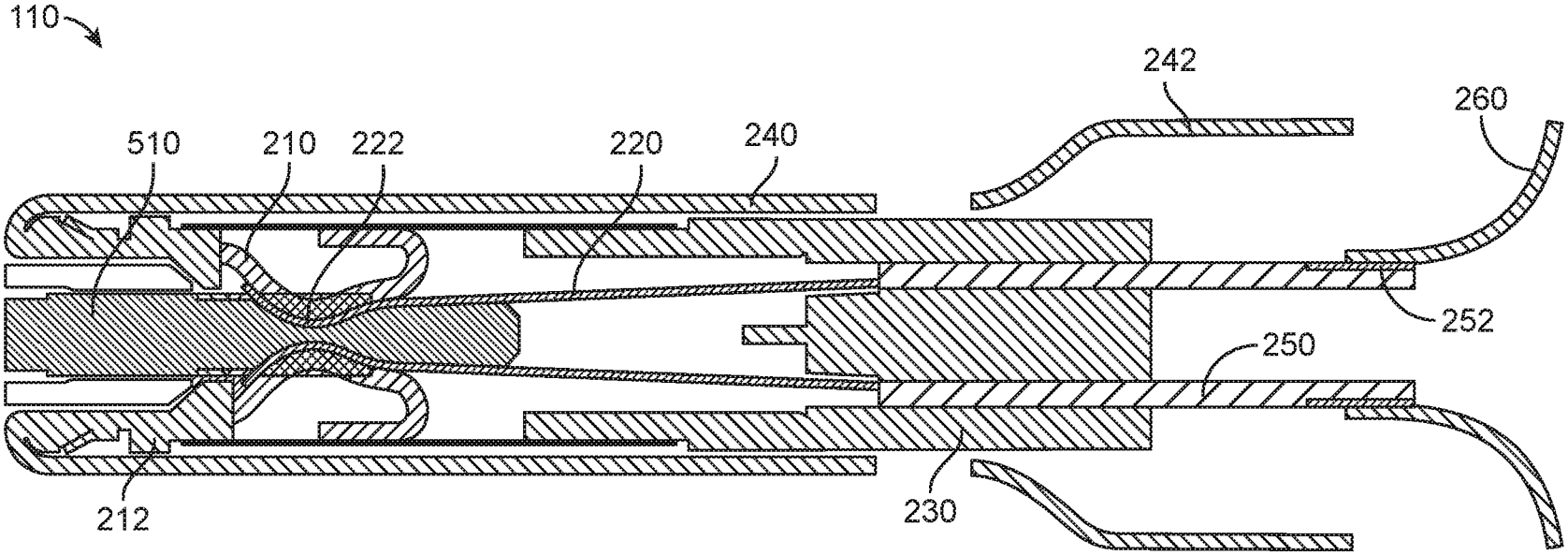
FIG. 2 illustrates a cutaway side view of a connector insert according to an embodiment of the present invention.
Figure 10:
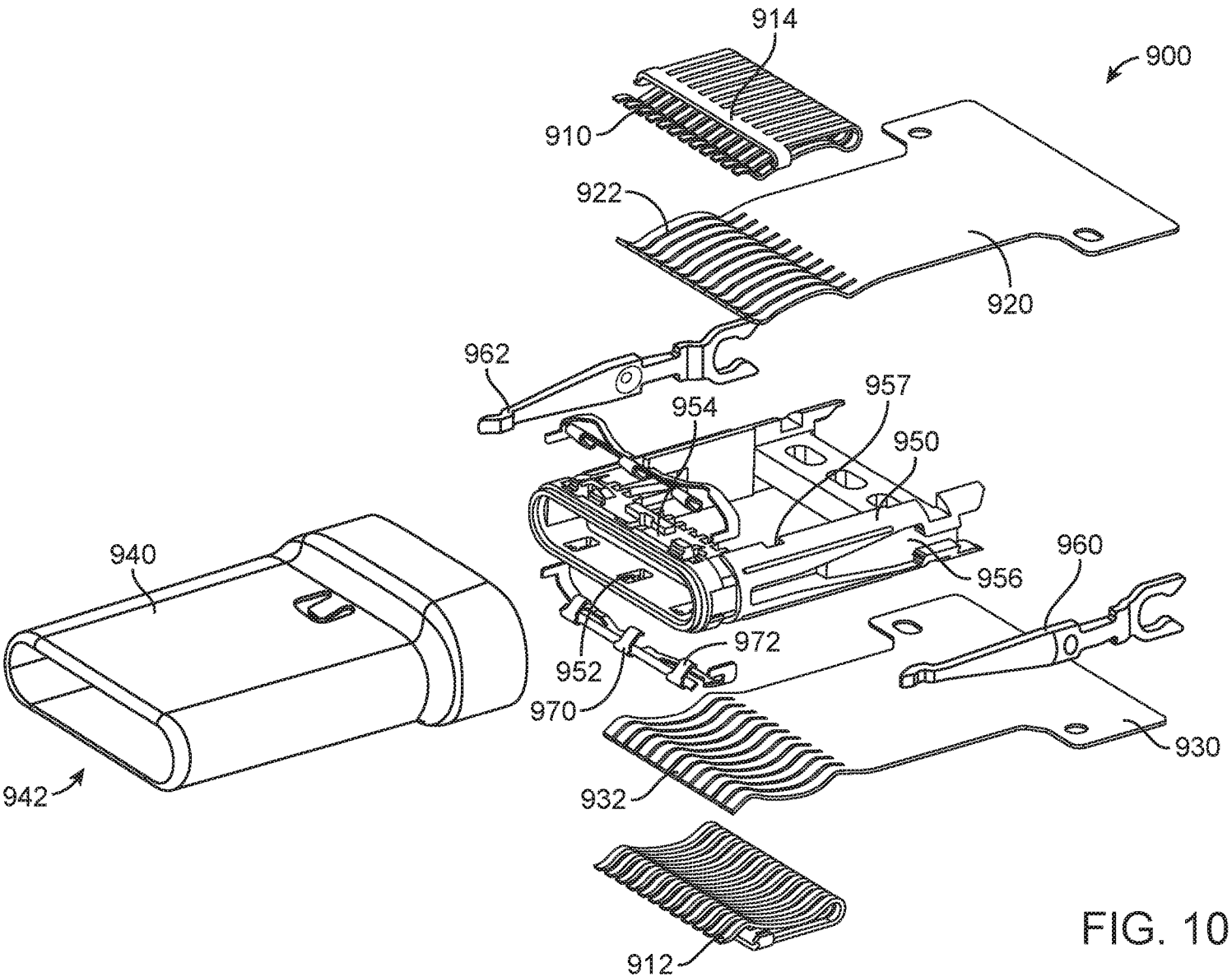
FIG. 10 is an exploded view of the connector insert of FIG. 9.

FIG. 2 illustrates a cutaway side view of a connector insert according to an embodiment of the present invention. Connector insert 110 can accept a tongue 510 of a connector receptacle 122 (shown in FIG. 5.) Contacts 924 (shown in FIG. 12) on contacting portions 222 in connector insert 110 can mate with contacts (not shown) on tongue 510 when connector insert 110 is mated with connector receptacle 122. Contacts 924 in connector insert 110 can be multi-structure contacts. In this example, these contacts 924 can include a metal layer (not shown) on traces 1322 (shown in FIG. 13) on contacting portions 222 of flexible circuit board 220, which can be attached to spring fingers 210. These multi-structure contacts can be located in a top and bottom of a passage in connector insert 110 (or 900 as shown in FIG. 10.) In these and other embodiments of the present invention, these contacts can be located in either a top or bottom of the passage in connector insert 110 (or 900 as shown in FIG. 10.) Spring fingers 210 can be supported by housings 212. Contacting portions 222 can be electrically isolated by shield 240. Shield 240 can electrically connect to rear shield 242. Flexible circuit boards 220 can connect to boards 250. Flexible circuit boards 220 can be multilayer or single layer flexible circuit boards. Boards 250 can be supported by housing 230. Contacts 252 on boards 250 can electrically connect to route paths 260. Route paths 260 can be wires, such as wires in a cable, additional flexible circuit boards, or other routing structures.

Spring fingers 210 can each support individual contacting portions 222, they can each support two contacting portions 222, or they can support more than two contacting portions 222. Spring fingers 210 can be in contact with shield 240 or they can be separate from shield 240.

More specifically, in these and other embodiments of the present invention, each spring finger 210 can provide support for one contacting portion 222 of a flexible circuit board 220. This arrangement can work well to ensure that each contact 924 on a contacting portion 222 of flexible circuit board 220 has a force to push it against a corresponding contact (not shown) when the contact 924 on the contacting portion 222 of the flexible circuit board 220 is mated with the corresponding contact.

In these and other embodiments of the present invention, each spring finger 210 can provide support for two contacting portions 222 of a flexible circuit board 220. Having two contacting portions 222 supported by each spring finger 210 can help to ensure that each contact 924 on a contacting portion 222 of flexible circuit board 220 has a force to push it against a corresponding contact when the contact 924 on the contacting portion 222 of the flexible circuit board 220 is mated with the corresponding contact.

In these and other embodiments of the present invention, each spring finger 210 can provide support for contacts 924 on more than two contacting portions 222 of a flexible circuit board 220. For example, each spring finger 210 can provide support for each of the contacts 924 on the flexible circuit board 220. Having a limited number of spring fingers 210 can help to simplify the assembly and manufacturing of components for a connector insert 110.

Spring fingers 210 can be conductive. Spring fingers 210 can be held in place by being partially encased in, or attached to, housing 212. Housing 212 can be formed of plastic, a ferritic or other magnetic material (to form a magnetic element), or other conductive or nonconductive material. Spring fingers 210 can be held in place by being attached to, or formed as part of, a shield around the connector, or a housing in the connector. Spring fingers 210 can be formed of steel, copper, bronze, spring steel, stainless steel, ceramic, or other material. Spring fingers 210 can be formed by stamping, metal-injection molding, forging, deep drawing, or other process.

In these and other embodiments of the present invention, spring fingers 210 can be nonconductive. Spring fingers 210 can be held in place by being partially encased or formed with housing 212. Spring fingers 210 can be attached to flexible circuit boards 220 using a pressure-sensitive adhesive, heat activated adhesive, temperature-sensitive adhesive, or other adhesive, laser or spot welding, or other material or process. Spring fingers 210 can be made of plastic, LCPs, rubber, foam, or other material. Spring fingers 210 can be formed by molding, injection molding, or other process. Housing 230 can be formed of plastic, and can be formed by injection molding or other process.

In these and other embodiments of the present invention, flexible circuit boards 220 can connect to boards 250. Route paths in flexible circuit boards 220 can electrically connect to traces in boards 250, which can terminate in contacts 252. Contacts 252 can be located on boards 250. In these and other embodiments of the present invention, flexible circuit boards 220 can instead bypass boards 250 and connect to route paths 260 via contacts 252, which can be located on flexible circuit boards 220.

In these and other embodiments of the present invention, route paths 260 can be routed in different directions. This can allow connector insert 110 to have cable that extends from connector insert 110 at a right angle or other angle to a contacting direction that connector insert 110 is inserted into connector receptacle 122 (shown in FIG. 5.)

Figure 3:
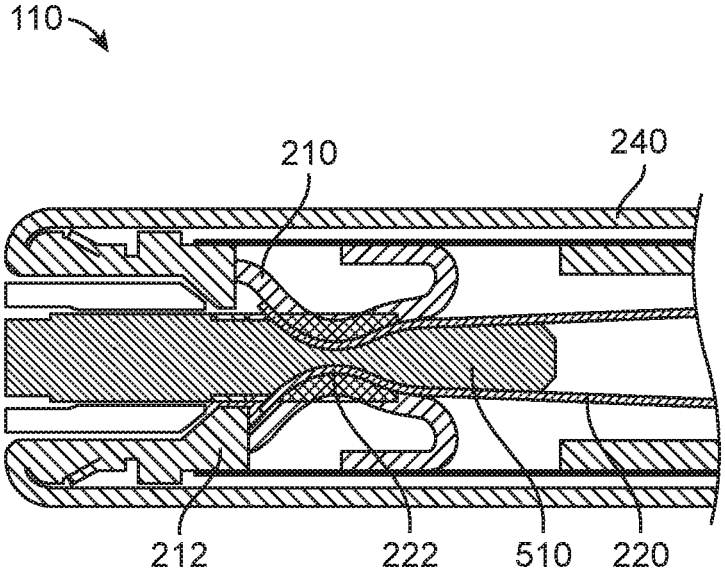
FIG. 3 illustrates a front portion of a connector insert according to an embodiment of the present invention.

FIG. 3 illustrates a front portion of a connector insert according to an embodiment of the present invention. Again, contacts 924 (shown in FIG. 12) on contacting portions 222 of connector insert 110 can mate with contacts (not shown) on top and bottom surfaces of tongue 510. Contacts 924 on contacting portions 222 can be formed on surfaces of flexible circuit boards 220, or attached to traces on surfaces of flexible circuit board 220. Spring fingers 210 can mechanically support contacting portions 222 of flexible circuit boards 220. Housing 212 can support spring fingers 210. Shield 240 can electrically isolate contacting portions 222.

In these multi-structure contacts, spring fingers 210 can provide mechanical support and contacting force for contacts 924 on contacting portions 222. That is, the spring fingers might not actually convey signals or power but instead can be utilized to provide a good mechanical electrical connection between contacts in mated connectors. Since signals are not routed through spring fingers 210, they can be formed of materials that are selected to provide a good spring force without regard to their conductivity. Since the remaining structures in the multi-structure contacts are not required to provide a spring force, contacts 924 on flexible circuit board 220 can convey signals for the connector insert 110. Contacts 924 on contacting portions 222 can connected to traces (not shown) of flexible circuit board 220. Flexible circuit board 220 can be a multilayer flexible circuit board to help improve signal quality. The traces of flexible circuit board 220 can use the multiple layers to provide matched traces, shielding, strip-lining, and other routing structure that can be used to improve signal quality and signal integrity. These routing techniques can reduce cross-talk, reduce electromagnetic interference, and enable a high data rate. Also, since the traces of flexible circuit board can begin (terminate) at contacting portions 222, stubs, which can be located at an end of a traditional beam contact, can be reduced or eliminated for further improved high-frequency performance.

By forming contacts in this way, traditional beam contacts are not needed. The absence of these beam contacts can result in free space inside a connector insert. This space can be used for components, which can be located on flexible circuit boards 220, boards 250, route paths 260, or elsewhere connector insert. The ability to locate components on these boards directly can enable the elimination of a paddle board that can otherwise be needed. The use of a boot over the paddle board can similarly be eliminated.

In these and other embodiments of the present invention, one or more magnets can also be located in the connector insert. An example is shown in the following figure.

Figure 4:
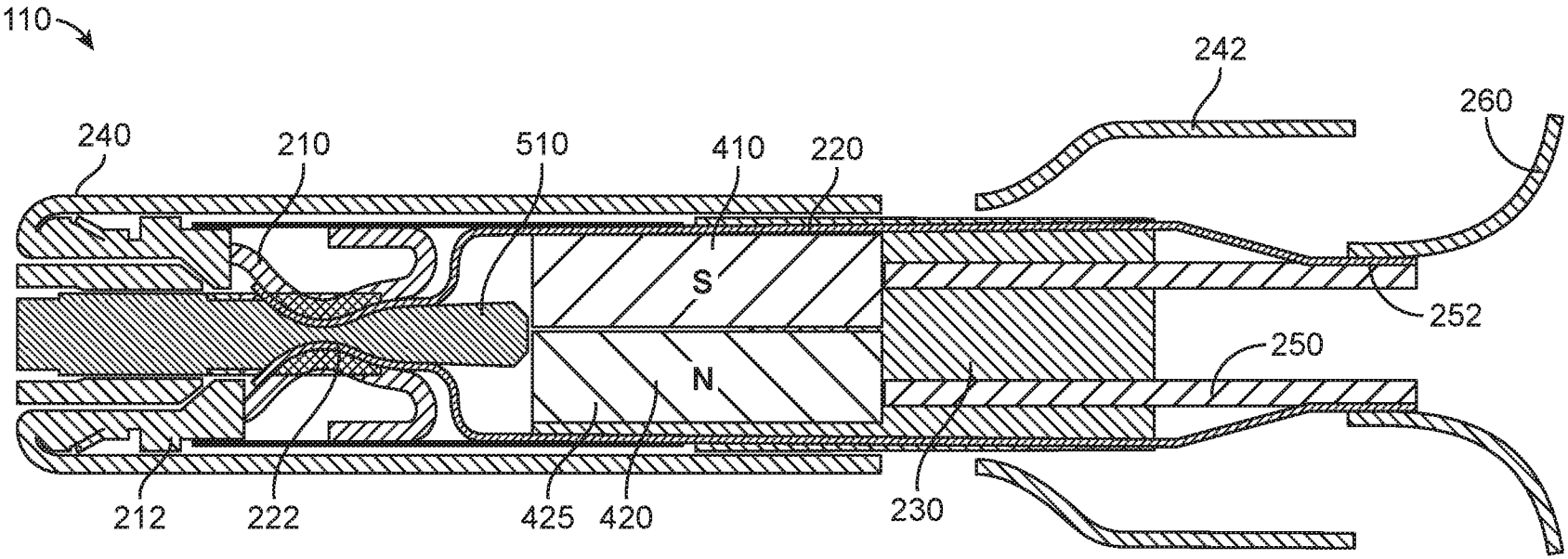
FIG. 4 illustrates another connector insert according to an embodiment of the present invention.

FIG. 4 illustrates another connector insert according to an embodiment of the present invention. As before, contacts 924 (show in FIG. 12) on contacting portions 222 on flexible circuit boards 220 can electrically connect to contacts (not shown) on tongue 510. Flexible circuit boards 220 can be attached to surfaces of spring fingers 210. Spring fingers 210 can be supported by housing 212. Flexible circuit boards 220 can terminate at contacts 252 on boards 250 and signals on flexible circuit boards 220 can be routed by route paths 260.

Again, the absence of beam contacts can provide additional space in connector insert 110. In this example, a magnet 425 can be included in connector insert 110. This magnet 425 can include a south pole 410 and a north pole 420. The south pole 410 and north pole 420 can attract a magnetic element (not shown) on tongue 510. For example, tongue 510 can include a metal-injection molded frame, where the injected metal forms a magnetic element. This can help to secure connector insert 110 in place in connector receptacle 122. An example is shown in the following figure.

Figure 5:
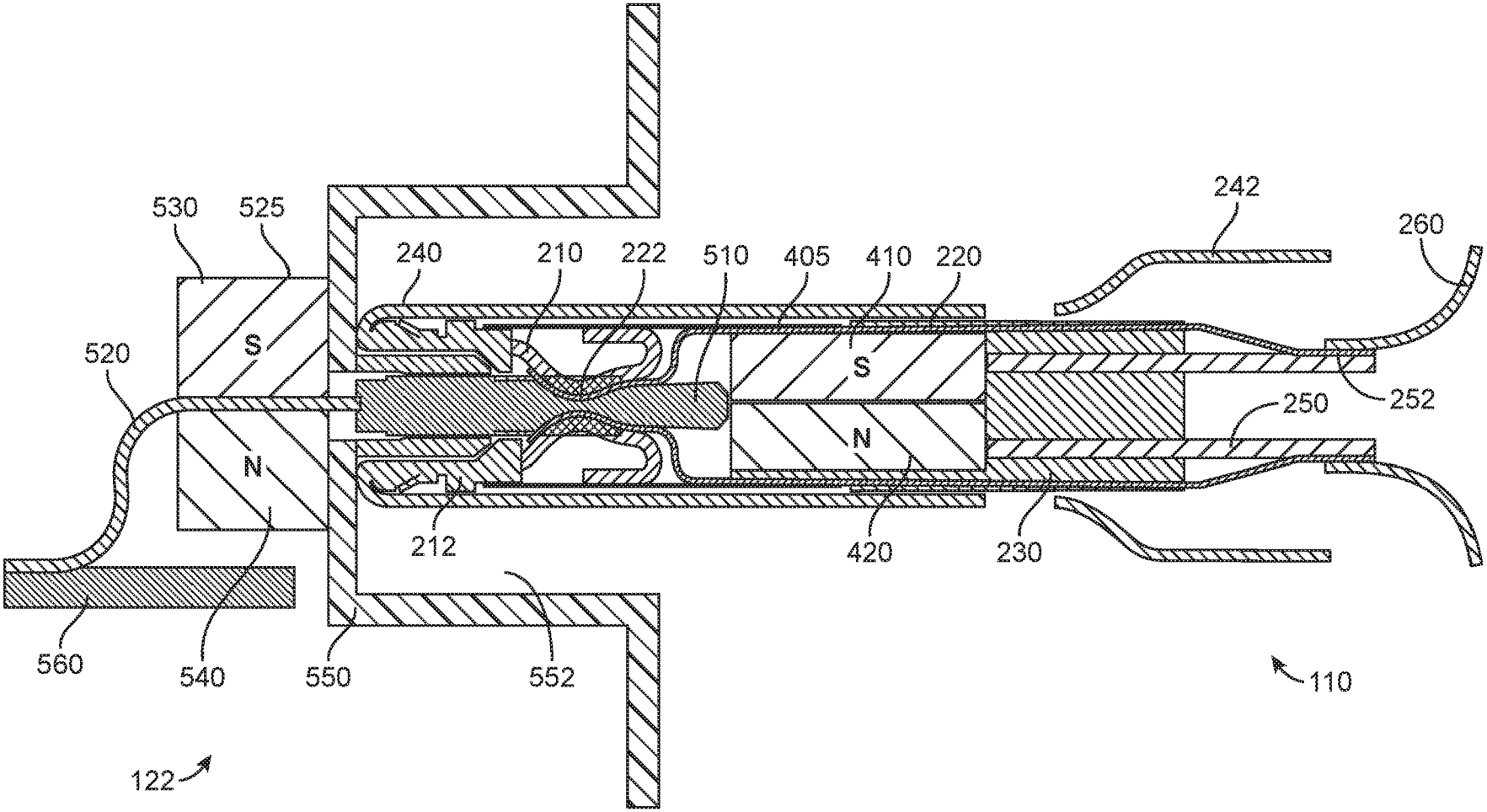
FIG. 5 illustrates a connector system according to an embodiment of the present invention.

FIG. 5 illustrates a connector system according to an embodiment of the present invention. In this example, connector insert 110 can be inserted in recess or passage 552 in device enclosure or receptacle housing 550, which can be the same or similar to device enclosure 102 in FIG. 1. Device enclosure or receptacle housing 550 can at least substantially house an electronic device that includes connector receptacle 122. Device enclosure or receptacle housing 550 can instead be a housing for connector receptacle 122.

As before, connector insert 110 can include contacts 924 (show in FIG. 12) on contacting portions 222 that can physically and electrically connect to contacts (not shown) on tongue 510 of connector receptacle 122. Contacts 924 can be formed on contacting portions 222. Contacting portions 222 can be supported by spring fingers 210, which can be supported by housing 212. In this example housing 212 can include a magnetic element (not shown.) Flexible circuit boards 220 can terminate at contacts 252 on board 250. Route paths 260 can be connected to contacts 252. Connector insert 110 can include shield 240.

Connector insert 110 can be mated with connector receptacle 122. Connector receptacle 122 can include a magnet 525 having a south pole 530 and a north pole 540. Route paths 520 can be connected to tongue 510 and can be attached to board 560.

In this example, magnet 405 in connector insert 110 can electrically attract a magnetic element (not shown) on tongue 510 of connector receptacle 122. For example, tongue 510 can include a metal-injection molded frame, where the injected metal forms a magnetic element. Magnet 525 in connector receptacle 122 can electrically attract a magnetic element (not shown) in housing 212. This can help to secure connector insert 110 in place with connector receptacle 122. These magnets can also provide a tactile response to a user when inserting connector insert 110 into connector receptacle 122.

These multi-structure contacts can be used in various ways in connectors consistent with embodiments of the present invention. For example, these multi-structure contacts can be used as contacts in a connector receptacle where the multi-structure contacts directly and electrically connect to contacts on a tongue of a connector insert. An example is shown in the following figure.

Figure 6:
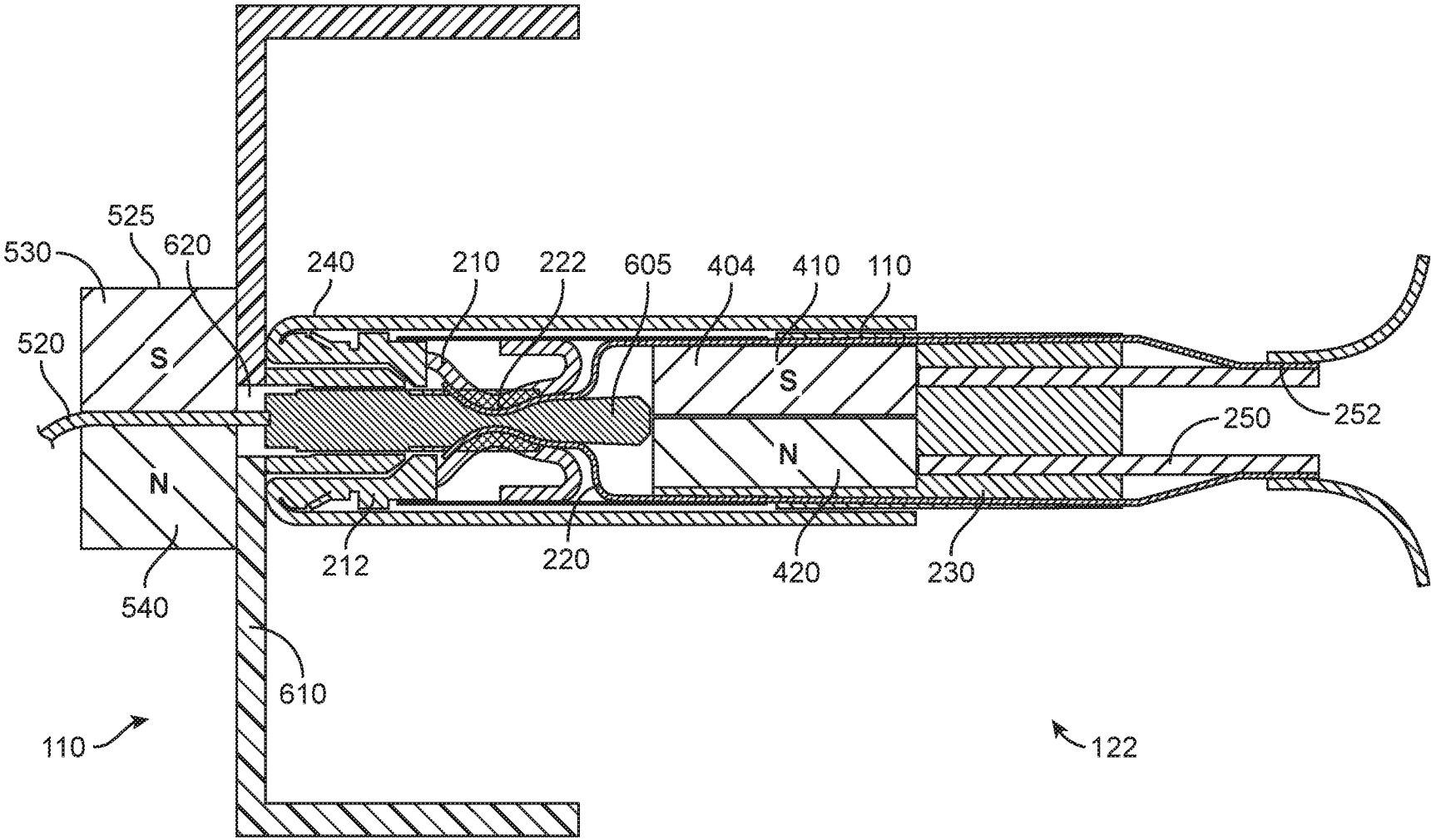
FIG. 6 illustrates another connector system according to an embodiment of the present invention.

FIG. 6 illustrates another connector system according to an embodiment of the present invention. In this example, connector insert tongue 605 can be mated with connector receptacle 122, which can be located in device enclosure 610, which can be the same or similar as device enclosure 102 in FIG. 1. Device enclosure 610 can instead be a housing for connector receptacle 122. Connector insert 110 can include magnet 525, route paths 520, and tongue 510. A housing (not shown) can support magnet 525.

Connector receptacle 122 can be part of an electronic device that can be at least substantially housed by device enclosure 610. Connector receptacle 122 can include contacts 924 (shown in FIG. 12) on contacting portions 222 that can physically and electrically connect to contacts (not shown) on tongue 605 of connector insert 110. Contacts 924 on contacting portions 222 can be formed on flexible circuit boards 220. Contacting portions 222 can be supported by spring fingers 210, which can be supported by housing 212. In this example housing 212 can include a magnetic element (not shown.) Flexible circuit boards 220 can terminate at contacts 252 on board 250. Route paths 260 can be connected to contacts 252. Connector receptacle 122 can be at least partially shielded by shield 240.

Again, these multi-structure contacts can be used in various ways in connectors consistent with embodiments of the present invention. For example, these multi-structure contacts can be used as contacts on a tongue of a connector insert where the multi-structure contacts directly and electrically connect to contacts in a connector receptacle when the connector insert and connector receptacle are mated. An example is shown in the following figure.

Figure 7:
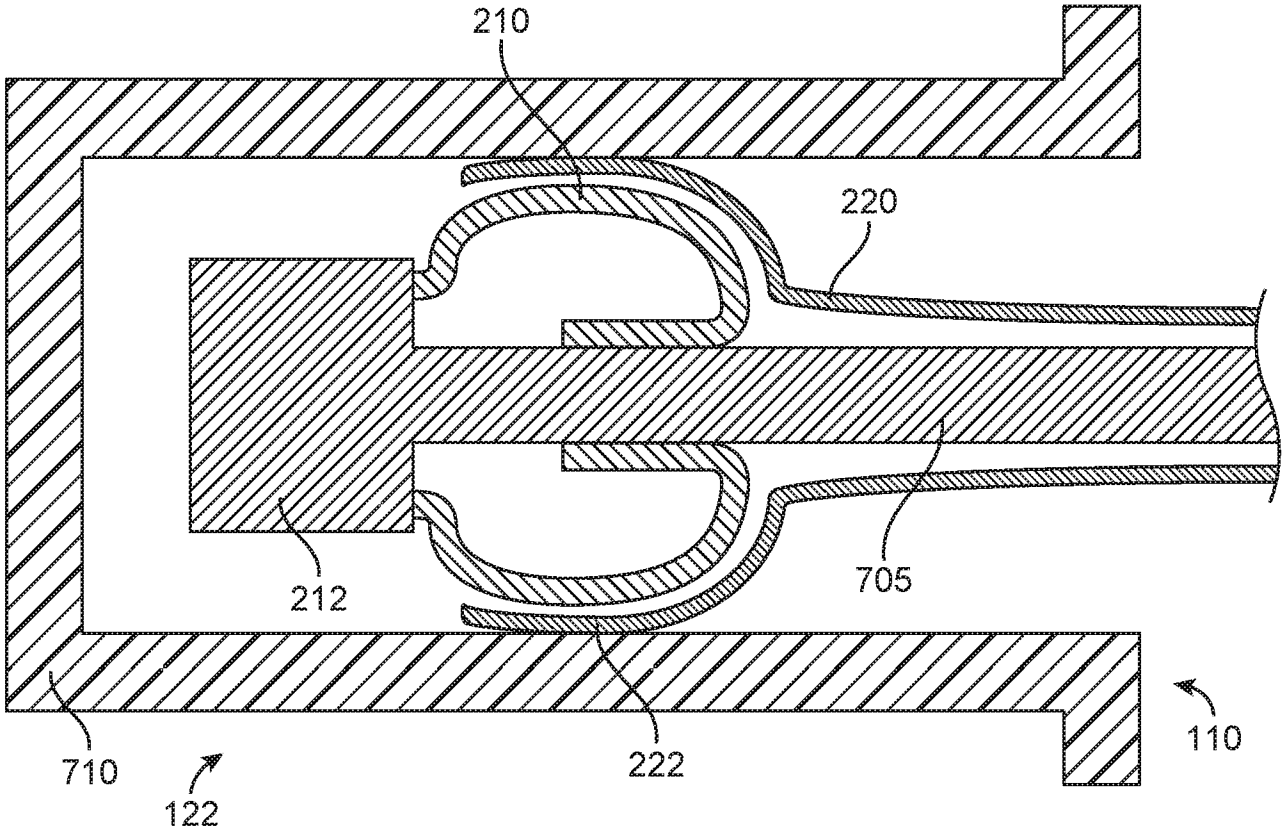
FIG. 7 illustrates another connector system according to an embodiment of the present invention.

FIG. 7 illustrates another connector system according to an embodiment of the present invention. In this example, connector insert 110 can include contacting portions 222 on flexible circuit boards 220. Flexible circuit boards 220 can be supported by spring fingers 210 on tongue 510. Spring fingers 210 can be supported by tongue portion or housing 212, which can be located on, or can be part of, tongue 705. Contacts 924 (shown in FIG. 12) on contacting portions 222 can physically and electrically contact connector receptacle contacts (not shown). These connector receptacle contacts can be supported by device enclosure 710. Device enclosure 710 can at least substantially house an electronic device that includes connector insert 110. Device enclosure 710 can instead be a portion of a housing for connector receptacle 122.

Again, these multi-structure contacts can be used in various ways in connectors consistent with embodiments of the present invention. For example, these multi-structure contacts can be used as contacts on a tongue of a connector receptacle where the multi-structure contacts directly and electrically connect to contacts in a connector insert when the connector insert and connector receptacle are mated. An example is shown in the following figure.

Figure 8:
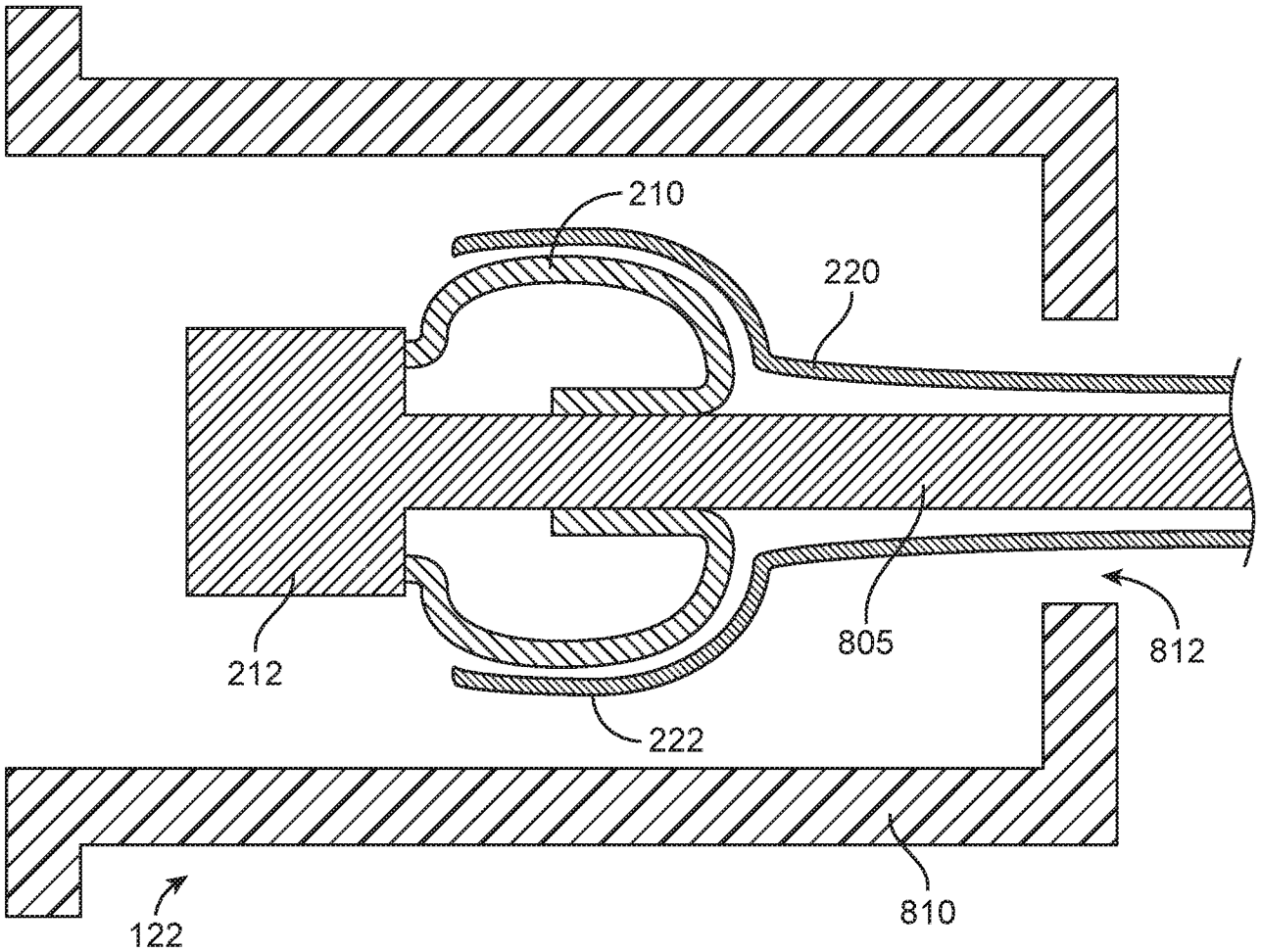
FIG. 8 illustrates a connector receptacle according to an embodiment of the present invention.

FIG. 8 illustrates a connector receptacle according to an embodiment of the present invention. In this example, connector receptacle 122 can include contacting portions 222 on flexible circuit boards 220. Flexible circuit boards 220 can be supported by spring fingers 210 on tongue 805. Spring fingers 210 can be supported by tongue portion or housing 212. Contacts 924 (show in FIG. 12) on contacting portions 222 can physically and electrically contact connector receptacle contacts (not shown). Tongue 805 can emerge from an opening 812 in device enclosure 810. Device enclosure 810 can at least substantially house an electronic device that includes connector receptacle 122. Device enclosure can be the same or similar to device enclosure 102 in FIG. 1. Device enclosure 810 can instead be a portion of a housing for connector receptacle 122.

Figure 9:
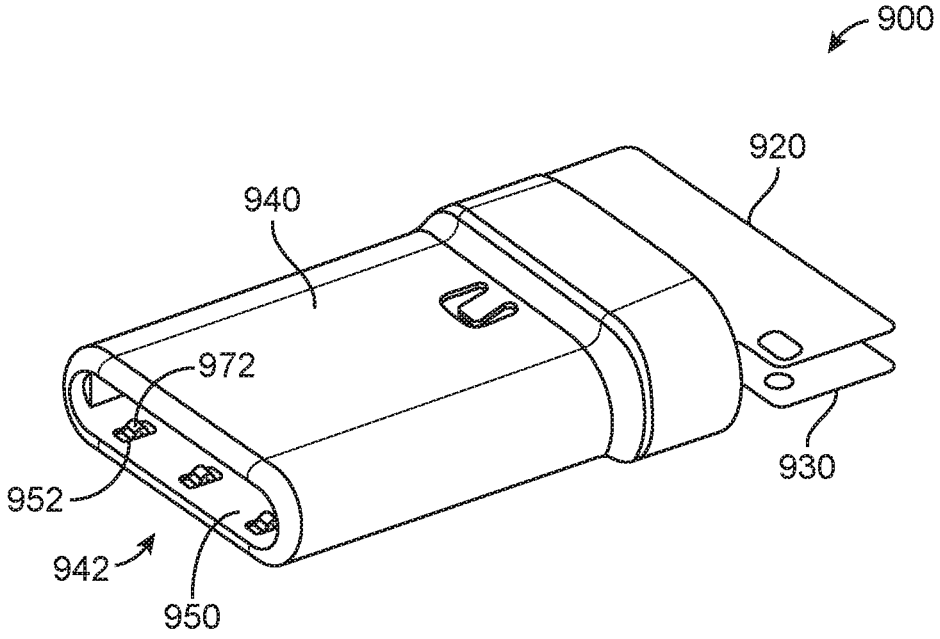
FIG. 9 illustrates another connector insert according to an embodiment of the present invention.

FIG. 9 illustrates another connector insert according to an embodiment of the present invention. Connector insert 900 can be a USB type C connector insert, though embodiments of the present invention can be incorporated in other types of connector inserts and connector receptacles. Connector insert 900 can be used as connector insert 124 in FIG. 1. Connector insert 900 can include housing 950 having openings 952 for ground contacts 972. Housing 950 can be formed of plastic or other nonconductive material, and can be formed by injection molding or other process. Housing 950 can be shielded by shield 940. Shield 940 can be metallic or otherwise conductive and can be formed by stamping, 3-D printing, deep-drawing, forging, molding, or other process. Shield 940 and housing 950 can have front opening 942. Front opening 942 can accept a tongue of a corresponding connector receptacle (not shown) and shield 940 can electrically connect to ground contacts (not shown) in the connector receptacle when connector insert 900 and the corresponding connector receptacle are mated. Flexible circuit boards 920 and 930 can be routed from a back end of connector insert 900.

FIG. 10 is an exploded view of the connector insert of FIG. 9. Connector insert 900 can include housing 950. Housing 950 can support side ground contacts 960 in slots 956. Side ground contacts 960 can include contacting portions 962 that can physically and electrically connect to contacts on the side of a tongue (not shown) in a corresponding connector receptacle (not shown.) Housing 950 can further support ground contact structures 970 in slots 954. Ground contact structures 970 can include ground contacts 972 that can be exposed at openings 952 of housing 950. Ground contacts 972 can physically and electrically connect to ground pads (not shown) on the tongue of the corresponding connector receptacle. Housing 950 can further support spring fingers 910 and 912 at notches 957.

In this example, spring fingers 910 and 912 can be the same or substantially similar to spring fingers 210 shown above, and they can be formed, operate, and be used in the same or similar manners.

Spring fingers 910 and 912 can each support individual contacting portions 922 and 932, they can each support two contacting portions 922 and 932, or they can support more than two contacting portions 922 and 932. Spring fingers 910 and 912 can be in contact with shield 940 or they can be separate from shield 940.

More specifically, in these and other embodiments of the present invention, each spring finger 910 and 912 can provide support for one contacting portion 922 and 932 of flexible circuit board 920 and 930. This arrangement can work well to ensure that each contact 924 on a contacting portion 922 or 932 of flexible circuit boards 920 and 930 has a force to push it against a corresponding contact (not shown) when each contact 924 on the contacting portions 922 and 932 of the flexible circuit boards 920 and 930 is mated with the corresponding contact.

In these and other embodiments of the present invention, each spring finger 910 and 912 can provide support for two contacting portions 922 and 932 of flexible circuit boards 920 and 930. Having two contacting portions 922 and 932 supported by each spring finger 910 and 912 can help to ensure that each contact 924 on a contacting portion 922 and 932 of flexible circuit boards 920 and 930 has a force to push it against a corresponding contact when each contact 924 on the contacting portions 922 and 932 of flexible circuit boards 920 and 930 is mated with the corresponding contact.

In these and other embodiments of the present invention, each spring finger 210 can provide support for contacts 924 on more than two contacting portions 222 of a flexible circuit board 220. For example, each spring finger 910 and 912 can provide support for each of the contacts 924 on flexible circuit boards 920 and 930. Having a limited number of spring fingers 910 and 912 can help to simplify the assembly and manufacturing of components for a connector insert 900.

In this example, spring fingers 910 and 912 can be individual spring fingers, though in these and other embodiments of the present invention, some or all of the spring fingers 910 and 912 can be joined. Similarly, each contacting portion 922 and 932 can be separate as shown, or some of all of contacting portions 922 and 932 can be joined. Each spring finger 910 and 912 can support one, two, three, or more contacting portions 922 and 932 of flexible circuit boards 920 and 930. Spring fingers 910 and 912 can be connected by connecting pieces 914.

In these and other embodiments of the present invention, spring fingers 910 (and 912) and contacting portions 922 (and 932) can be arranged in various ways. Again, each spring finger 910 can support one, two, three, or more contacting portions 922. Each contacting portion 922 can support one or more contacts 924. For example, a spring finger 910 may support a contacting portion 922 having one contact 924. A spring finger 910 may support a contacting portion 922 having two contacts 924. A single spring finger 910 can support a single contacting portion 922 having all the contacts 924 of a row. Other configurations are also possible.

Spring fingers 910 and 912 can be conductive. Spring fingers 910 and 912 can be held in place by being partially encased in, or attached to, housing 950. Spring fingers 910 and 912 can be held in place by being attached to, or formed as part of, a shield around the connector, or a housing in the connector. Spring fingers 910 and 912 can be formed of steel, copper, bronze, spring steel, stainless steel, ceramic, or other material. Spring fingers 910 and 912 can be formed by stamping, metal-injection molding, forging, deep drawing, or other process.

In these and other embodiments of the present invention, spring fingers 910 and 912 can be nonconductive. Spring fingers 910 and 912 can be held in place by being partially encased or formed with housing 950. Spring fingers 910 and 912 can be formed as part of the housing 950 for the connector. Spring fingers 910 and 912 can be attached to flexible circuit boards 920 and 930 using a pressure-sensitive adhesive, heat activated adhesive, temperature-sensitive adhesive, or other adhesive, laser or spot welding, or other material or process. Spring fingers 910 and 912 can be made of plastic, LCPs, rubber, foam, or other material. Spring fingers 910 and 912 can be formed by molding, injection molding, or other process.

Flexible circuit boards 920 and 930 can include contacting portions 922 and 932 that can be aligned and fixed to spring fingers 910 and 912. Contacting portions 922 can be adhesively attached to spring fingers 910, while contacting portions 932 can be adhesively attached to spring fingers 912. Keeping spring fingers 910 and 912 separate and not joined can improve the planarization of contacts 924 (shown in FIG. 13) on contacting portions 922 and 932 of flexible circuit boards and 20 and 930. Housing 950 can be enclosed in shield 940. Shield 940 and housing 950 can include front opening 942 for accepting the tongue of the corresponding connector receptacle.

Figure 11:
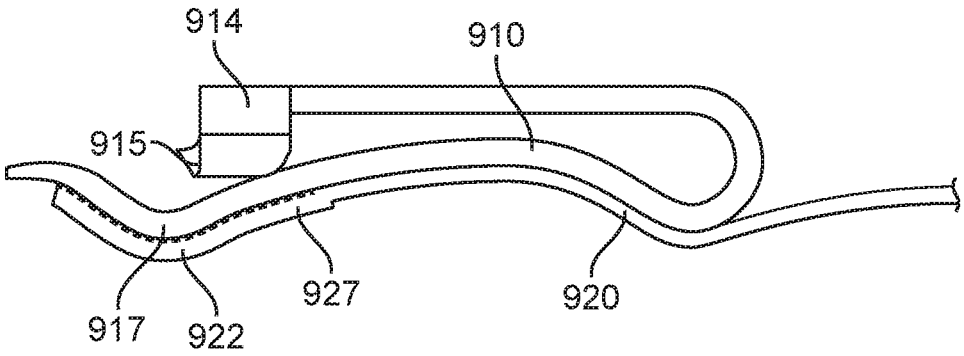
FIG. 11 is a cutaway side view of a portion of the connector insert of FIG. 9.

FIG. 11 is a cutaway side view of a portion of the connector insert of FIG. 9. In this example, spring finger 910 can be attached to notch 957 on housing 950 (shown in FIG. 10) by tab 915 on connecting piece 914. Flexible circuit board 920 can include a thicker portion 927 for durability reasons. Thicker portion 927 of flexible circuit board 920 can include a contacting portion 922 over contacting point 917 of spring finger 910. A contact 924 (shown in FIG. 13) can be formed over contacting point 917 and can extend over some or all of thicker portion 927. In these and other embodiments of the present invention, thicker portion 927 can be omitted, and flexible circuit board 920 can have a uniform width along the length of spring finger 910.

In these and other embodiments of the present invention, signals can be routed from contacts on a flexible circuit board to a second flexible circuit board, printed circuit board, or other appropriate substrate. An example of how this can be done is shown in the following figure.

Figure 12:
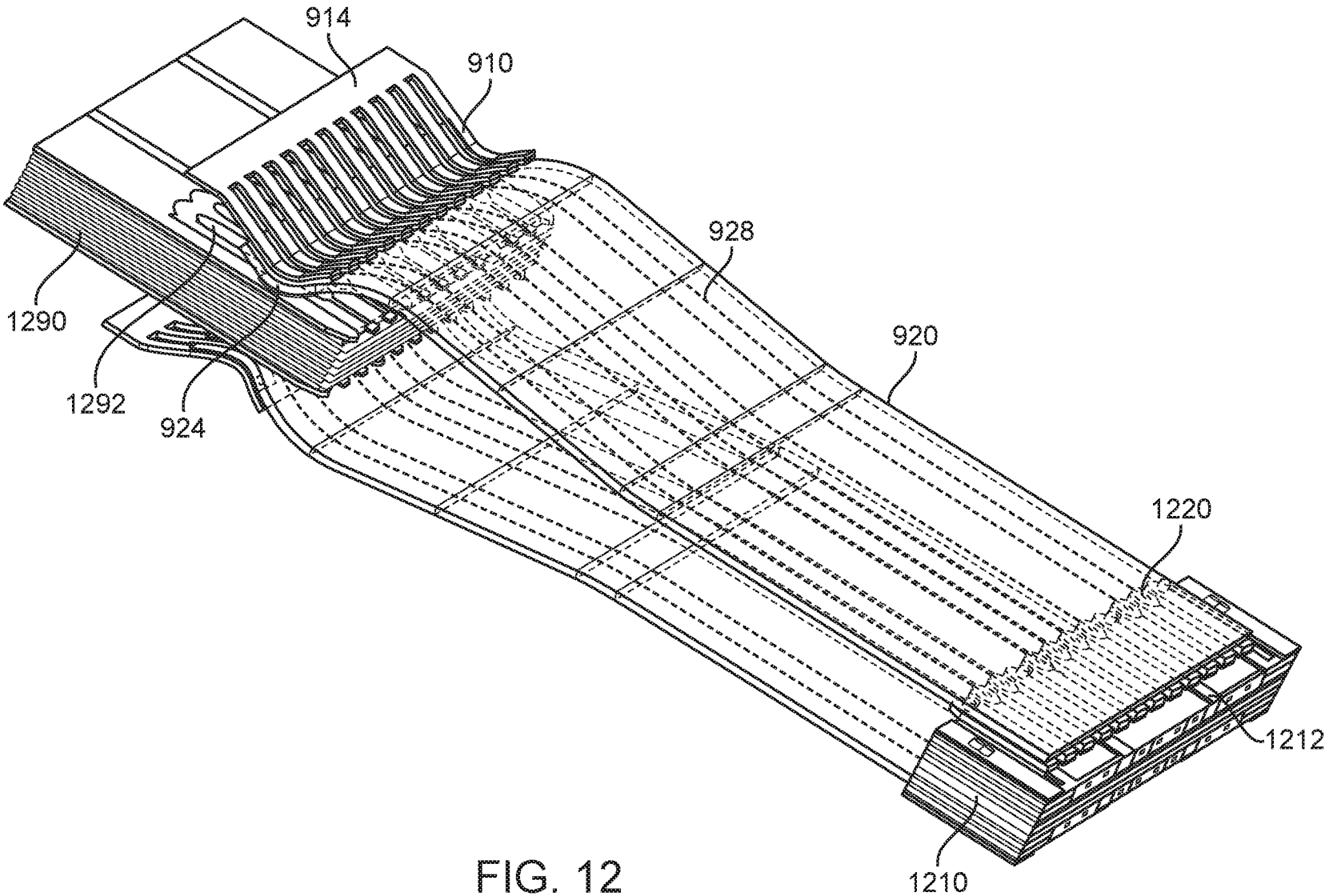
FIG. 12 illustrates a portion of a connector insert and associated structures according to an embodiment of the present invention.

FIG. 12 illustrates a portion of a connector insert and associated structures according to an embodiment of the present invention. In this example, spring fingers 910 can be joined by connecting piece 914. Spring fingers 910 can provide support for contacting portions 922 (shown in FIG. 11) of flexible circuit board 920. Contacts 924 can be formed on a bottom surface of flexible circuit board 920. Contacts 924 can make electrical connections with contacts 1292 on tongue 1290. Tongue 1290 can be a tongue of a corresponding connector receptacle (not shown) that is mated to this connector insert. Contacts 924 can electrically connect to traces 928 in flexible circuit board 920. Some or all of traces 928 can connect to traces (not shown) in printed circuit board 1210 through vias 1220. Some or all of traces 928 can instead connect through vias 1220 to traces 1212 on a surface of printed circuit board 1210.

Again, flexible circuit boards 220, 920, and 930 can be multilevel flexible circuit boards. An example is shown in the following figure. In this example, bottom, middle, and top layers of a flexible circuit board can be included.

Figure 13:
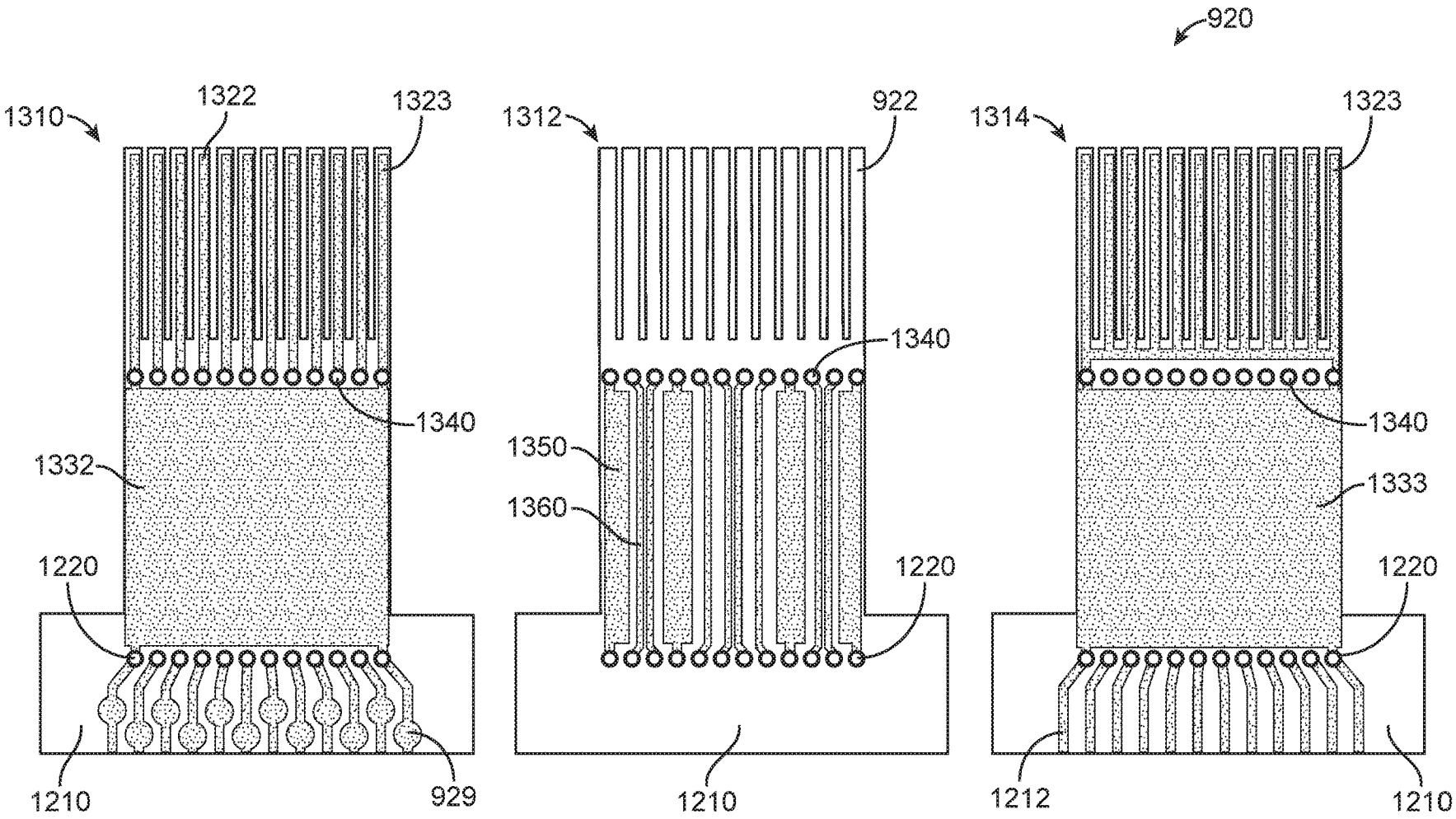
FIG. 13 illustrates layers of a multilevel flexible circuit board according to an embodiment of the present invention.

FIG. 13 illustrates layers of a multilevel flexible circuit board according to an embodiment of the present invention. In this example, flexible circuit board 920 (which can be the same as flexible circuit boards 220 and 930) can include a bottom layer 1310, a middle layer (shown here as Layer2) 1312, and a top layer 1314. In these and other embodiments of the present invention, one or more of these layers can be omitted or one or more other layers can be added. Contacts 924 (shown in FIG. 12) can be attached to traces 1322 and 1323 on contacting portions 922. Contacts 924 can be soldered, attached by adhesive, or attached in other ways to contacting portions 922. For example, pressure-sensitive adhesive, heat activated adhesive, temperature-sensitive adhesive, or other adhesive can be used. Traces 1322 and 1323 can electrically connect to vias 1340. Vias 1340 can electrically connect to each other on bottom layer 1310, middle layer 3012, and top layer 1314, and can provide a routing path for signals on traces 1322 to reach traces 1350 and 1360 on middle layer 1312. Wider traces 1350 can be used by ground or power supplies, while the narrower traces 1360 can be used for signals, such as high-speed differential signals. Ground plane 1332 on bottom layer 1310 and ground plane 1333 on top layer 1314 can shield traces 1360. Traces 1323 can electrically connect to ground plane 1332 and ground plane 1333. Traces 1350 and 1360 can connect to vias 1220. Vias 1220 can connect to each other on bottom layer 1310, middle layer 3012, and top layer 1314. Vias 1220 can connect to vias 929 on printed circuit board 1210. Vias 929 can connect to route paths on different layers (not shown) in printed circuit board 1210. Vias 1220 can also connect to traces 1212.

In this way, high-speed differential signals conveyed by flexible circuit board 920 can be well-shielded. This shielding can protect the differential signals being conveyed on flexible circuit board 920, and can prevent differential signals being conveyed on flexible circuit board 920 from coupling to other signals or circuits. For example, a differential signal can be conveyed on two traces 1322 to two vias 1340 on bottom layer 1310. The differential signal can then be conveyed on two of the traces 1360. Each pair of traces 1360 can be shielded by ground or power supplies on traces 1350, as well as ground plane 1332 on bottom layer 1310 and ground plane 1333 on top layer 1314. The short distance between contacts 924 on traces 1322 and the vias 1340 can also help to shield the differential signals by allowing ground plane 1332 on bottom layer 1310 and ground plane 1333 on top layer 1314 to extend close to contacts 924.

The additional shielding provided by placing ground planes 1332 and 1333 close to the contacts 924 means that the connector has a shorter region where the signals conveyed by contacts 924 are not carried on a transverse electromagnetic (TEM) transmission line. A TEM transmission line (for example the stripline as shown here) has a well-defined impedance with less variation, giving much better return loss, less crosstalk, less mode conversion, and lower insertion loss.

Since the TEM transmission line can be positioned close to contacts 924, the non-TEM zone (unshielded length of traces 1360) of the signal path for signals conveyed by contacts 924 can be made short. This can provide several benefits. It can push the onset of a given level of near-end cross-talk (NEXT) and far-end cross-talk (FEXT) coupling to higher frequencies, moving significant coupling above the operating frequency (the data rate of the signals conveyed by contacts 924.) For example, when the non-TEM zone is a first factor shorter, the coupling effects can be moved higher in frequency by approximately the same first factor. By reducing the unshielded length of traces 1360, coupling can be moved above the data rate of the signals they convey.

There can be resonances formed in connectors by a conductor loop on a ground, power supply, or any net which has multiple contacts. These multi-contacts nets can form transmission line resonators due to the shorted loops created in that net. Shortening these loops such that they have a reduced electrical length can push the resonant frequency higher, above the connectors target operating frequency or data rate of signals on traces 1360. Making these loops electrically shorter by a first factor increases the resonance frequencies by approximately the first factor.

The shorter contact region and the strip line structure of the flex circuit can further result in more of the common-mode current finding a path through the flex contacts 924 and traces 1360 as opposed to other structures, such as ground planes 1332 and 1333. This can result in a reduction in common-mode current in the shield, which can reduce EMI proportional to the reduction of common-mode shield current reduction. The design enables a lower common-mode impedance discontinuity by the shorter non-TEM zone. It can also help to maintain symmetry of a ground, differential signal, and power supply pin group. Further, the conductor shape of power supply traces 1350 can be tailored to improve the coupling between the power supply on traces 1350 and ground planes 1332 and 1332.

In these and other embodiments of the present invention, a shape of power supply traces 1350 can be adjusted in a flex assembly, where power supply coupling to ground and other power supply traces might not be easily executed in a traditional pin field. Coupling components, such as capacitors, can also be included to increase coupling. These features can enable common-mode continuity across the connector as the power supply becomes a more effective return path for residual common-mode currents related to the signals on contacts 924 and traces 1360.

The body of the flex between spring fingers 910 (shown in FIG. 12) and contacts 924 can further reduce cross-talk. For example, ground vias (not shown) can be stitched between signal pairs and from traces 1323 on a top layer 1314 of flexible circuit board 920 to ground.

Figure 14:
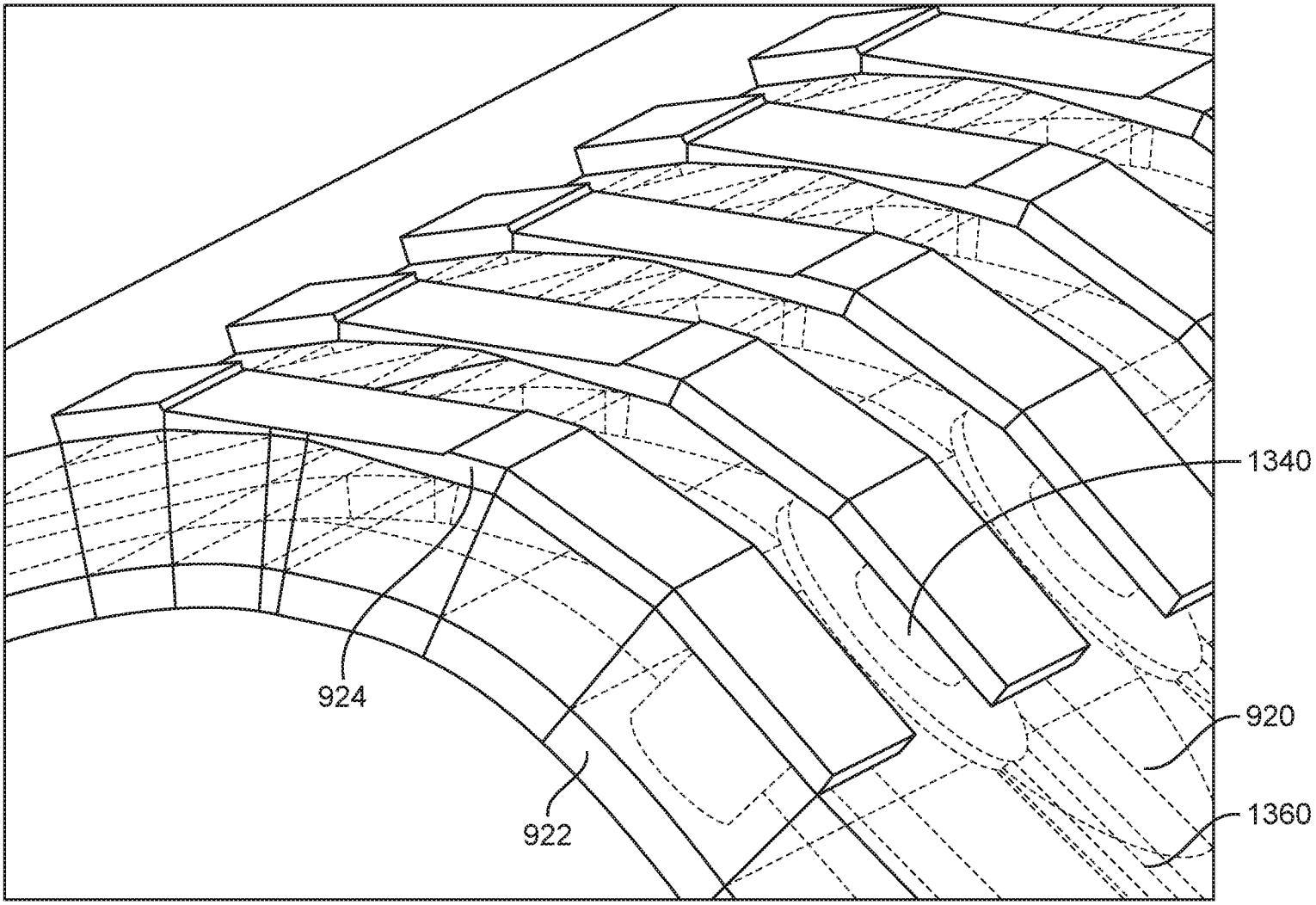
FIG. 14 illustrates contacts on a surface of a flexible circuit board according to an embodiment of the present invention.

FIG. 14 illustrates contacts on a surface of a flexible circuit board according to an embodiment of the present invention. In this example, contacts 924 can be formed on a surface of contacting portions 222 of flexible circuit board 920. Contacts 924 can be plated, formed by vapor deposition, soldered, or formed in other ways on contacting portions 922 of flexible circuit board 920 (and flexible circuit board 220 and 930 in the other examples.) Contacts 924 can be connected through vias 1340 to traces 1360 in flexible circuit board 920. The close position of via 1342 contacts 924 can reduce the length of a trace for which a signal on contact 924 is unshielded by ground planes 1332 and 1333 and traces 1350, as shown in FIG. 13. Contacts 924 can be multi-structure contacts in that they are formed of a metal layer fixed to a metal trace 1322 on a contacting portion 922 of flexible circuit board 920, which can be attached to spring finger 910.

While embodiments of the present invention can be useful as USB Type-C connector inserts and connector receptacles, these and other embodiments of the present invention can be used as connector receptacles in other types of connector systems, such as a Peripheral Component Interconnect express (PCIe) connector system.

In various embodiments of the present invention, spring fingers, contacts, shields, and other conductive portions of a connector insert or connector receptacle can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the housings, spring fingers, and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards used can be formed of FR-4 or other material. The contacts can be plated, formed by vapor deposition, soldered, or formed in other ways on the flexible circuit boards.

Embodiments of the present invention can provide connector receptacles and connector inserts that can be located in, and can connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Peripheral Component Interconnect express, Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles can be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector comprising:

a housing having a passage to accept a tongue of a corresponding connector, the passage defining a front opening in the housing;

a first spring finger attached to a top of the housing at an attachment point of the first spring finger, the first spring finger having a first portion extending from the attachment point of the first spring finger away from the front opening, the first spring finger folded such that a second portion of the first spring finger extends under the first portion of the first spring finger and towards the front opening to a contacting point of the first spring finger;

a second spring finger attached to a bottom of the housing at an attachment point of the second spring finger, the second spring finger having a first portion extending from the attachment point of the second spring finger away from the front opening, the second spring finger folded such that a second portion of the second spring finger extends over the first portion of the second spring finger and towards the front opening to a contacting point of the second spring finger;

a first flexible circuit board attached to a bottom side of the first spring finger;

a second flexible circuit board attached to a top side of the second spring finger;

a first contact on a bottom side of the first flexible circuit board and aligned with the contacting point of the first spring finger; and a second contact on a top side of the second flexible circuit board and aligned with the contacting point of the second spring finger.

2. The connector of claim 1 wherein the first spring finger is plastic.

3. The connector of claim 1 wherein the first spring finger is metal.

4. The connector of claim 3 further comprising a shield around the first spring finger and the second spring finger.

5. The connector of claim 4 wherein the first spring finger and the second spring finger are attached to the shield.

6. The connector of claim 1 wherein the first flexible circuit board is attached to the first spring finger using a pressure-sensitive adhesive.

7. The connector of claim 1 wherein the connector is a connector insert.

8. The connector of claim 1 wherein the connector is a connector receptacle.

9. A connector comprising:

a passage to accept a tongue of a corresponding connector, the passage defining a front opening;

a first plurality of spring fingers at a top of the passage;

a second plurality of spring fingers at a bottom of the passage;

a first flexible circuit board attached to a bottom side of the first plurality of spring fingers, wherein the first flexible circuit board comprises:

a bottom layer supporting a plurality of first traces and a first ground plane;

a middle layer supporting a plurality of second traces over the first ground plane, the second traces in the plurality of second traces coupled to corresponding first traces in the plurality of first traces by a plurality of vias; and a top layer supporting a second ground plane over the plurality of second traces;

a second flexible circuit board attached to a top side of the second plurality of spring fingers;

a first plurality of contacts on a bottom side of the first flexible circuit board, each of the first plurality of contacts attached to a corresponding first trace in the plurality of first traces on the bottom layer of the first flexible circuit board; and a second plurality of contacts on a top side of the second flexible circuit board.

10. The connector of claim 9 wherein the first plurality of spring fingers are plastic.

11. The connector of claim 9 wherein the first plurality of spring fingers are metal.

12. The connector of claim 11 further comprising a shield around the first plurality of spring fingers and the second plurality of spring fingers.

13. The connector of claim 12 wherein the first plurality of spring fingers and the second plurality of spring fingers are attached to the shield.

14. The connector of claim 9 wherein the first flexible circuit board is attached to the first plurality of spring fingers using a pressure-sensitive adhesive.

15. The connector of claim 9 wherein the connector is a connector insert.

16. The connector of claim 9 wherein the connector is a connector receptacle.

17. A connector system comprising:

a connector insert comprising:

a passage to accept a tongue of a connector receptacle, the passage defining a front opening;

a first spring finger at a top of the passage;

a second spring finger at a bottom of the passage;

a first flexible circuit board attached to a bottom side of the first spring finger;

a second flexible circuit board attached to a top side of the second spring finger;

a first contact on a bottom side of the first flexible circuit board, wherein the first flexible circuit board is reinforced with an additional thickness over the first contact; and a second contact on a top side of the second flexible circuit board, wherein the second flexible circuit board is reinforced with an additional thickness under the second contact; and the connector receptacle comprising:

the tongue supporting a first contact to mate with the first contact of the connector insert and a second contact to mate with the second contact of the connector insert when the connector insert is mated with the connector receptacle.

18. The connector system of claim 17 further comprising a magnetic element in the connector insert and a magnetic element on the tongue.

19. The connector system of claim 18 wherein the connector insert further comprises a shield around the first spring finger and the second spring finger.

20. The connector system of claim 19 wherein the first spring finger and the second spring finger are supported by a housing of the connector insert.

* * * * *